US005791700A

United States Patent [19]

Biro

[11] Patent Number: 5,791,700

[45] Date of Patent: Aug. 11, 1998

[54] LOCKING SYSTEM FOR A WINDOW

[75] Inventor: Alexander J. Biro, Gibsonia, Pa.

[73] Assignee: Winchester Industries, Inc., Saltsburg, Pa.

[21] Appl. No.: 664,230

[22] Filed: Jun. 7, 1996

[51] Int. Cl.[6] ..... E05C 9/00

[52] U.S. Cl. ..... 292/7; 292/36; 292/DIG. 20; 292/DIG. 47; 49/174; 49/449

[58] Field of Search ..... 292/5, 7, 36, DIG. 20, 292/DIG. 47, DIG. 38; 49/174, 176, 458, 449; 70/89, 90

[56] References Cited

U.S. PATENT DOCUMENTS

| | | | |
|---|---|---|---|
| 166,842 | 8/1875 | Berryman | 292/7 |
| 590,225 | 9/1897 | Hill | 292/7 |
| 722,162 | 3/1903 | Louis | 292/7 |
| 1,041,803 | 10/1912 | Kilburn | 292/36 |
| 1,704,946 | 3/1929 | Lindgren | 292/36 |
| 1,864,253 | 6/1932 | McIntyre | 49/449 |
| 1,869,274 | 7/1932 | Philips . | |
| 2,818,919 | 1/1958 | Sylvan | 49/449 |
| 3,599,452 | 8/1971 | Yokohama et al. | 70/90 |
| 4,151,682 | 5/1979 | Schmidt | 49/458 |
| 4,303,264 | 12/1981 | Uehara | 292/7 |
| 4,470,277 | 9/1984 | Uyeda | 70/118 |
| 4,525,952 | 7/1985 | Cunningham et al. | 49/449 |
| 4,580,366 | 4/1986 | Hardy | 49/458 |
| 4,639,021 | 1/1987 | Hope | 292/7 |
| 4,643,005 | 2/1987 | Logas | 292/5 |
| 4,827,685 | 5/1989 | Schmidt | 49/458 |
| 4,922,658 | 5/1990 | Coddens | 49/458 |
| 4,949,506 | 8/1990 | Durham, Jr. | 49/449 |
| 5,090,750 | 2/1992 | Lindqvist | 292/7 |
| 5,143,412 | 9/1992 | Lindqvist | 292/DIG. 47 |
| 5,244,238 | 9/1993 | Lindqvist | 292/36 |
| 5,274,955 | 1/1994 | Dallaire et al. | 49/458 |
| 5,341,752 | 8/1994 | Hambleton | 109/59 |
| 5,398,447 | 3/1995 | Morse | 292/DIG. 20 |
| 5,454,609 | 10/1995 | Slocomb et al. | 292/DIG. 47 |
| 5,560,149 | 10/1996 | Lafevre | 49/449 |

FOREIGN PATENT DOCUMENTS

| | | | |
|---|---|---|---|
| 621503 | 6/1961 | Canada | 292/36 |
| 10118 | of 1913 | United Kingdom . | |
| 270053 | 3/1927 | United Kingdom | 292/7 |
| 1364444 | 8/1974 | United Kingdom | 292/36 |
| 2026594 | 2/1990 | United Kingdom | 292/DIG. 42 |

*Primary Examiner*—Steven N. Meyers
*Assistant Examiner*—Tuyet-Phuong Pham
*Attorney, Agent, or Firm*—Alan G. Towner; Eckert Seamans Cherin & Mellott, LLC

[57] ABSTRACT

A locking system for a window sash comprises a lock handle assembly, reciprocating rod members connected to the lock handle assembly, and rotatable cam assemblies connected to the rod members. Each cam assembly has a cam element which upon reciprocation of its respective rod element moves into and out of a cam keeper which is mounted on an adjacent window sash. Each rod member has a rod tip which moves into and out of a channel provided in the window frame. In a first operation of the lock handle assembly, the rod members are reciprocated inwardly to rotate the cam elements out of their respective cam keeper and to move the rod tips partially out of the frame channels which allows the window sash to be moved vertically within the channels. A further operation of the lock handle assembly moves the rod tips entirely out of the channels to allow the window sash to be tilted.

50 Claims, 3 Drawing Sheets

FIG. 1
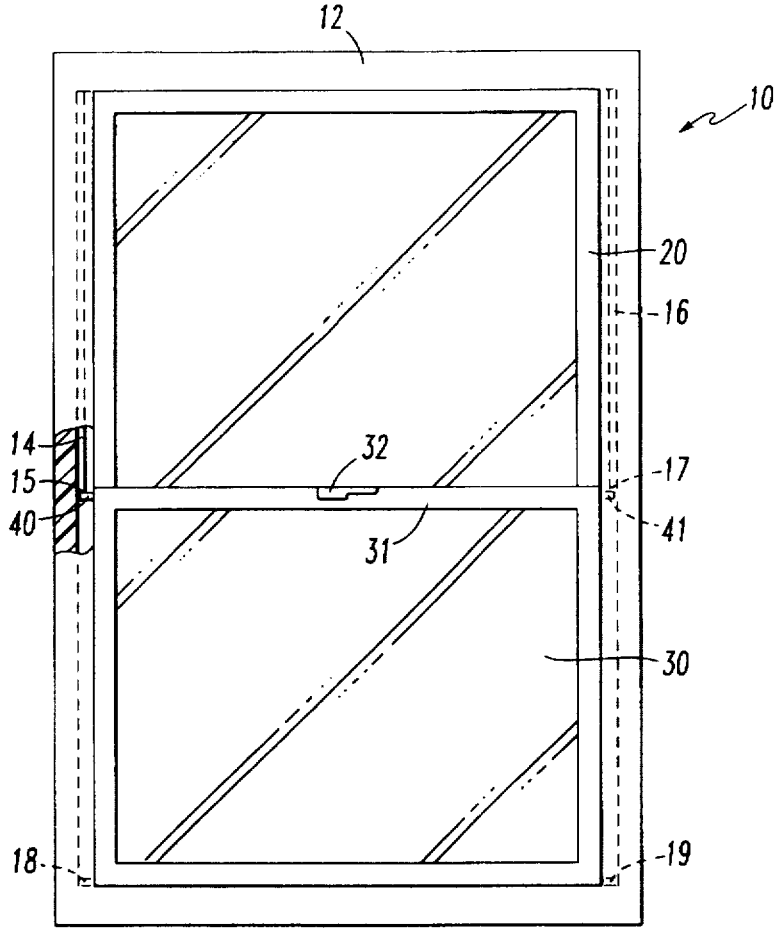
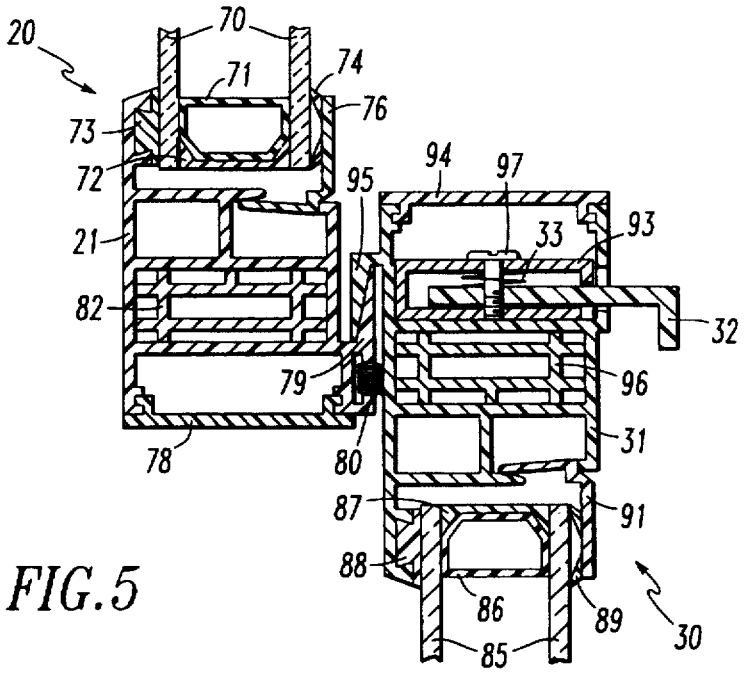
FIG. 5

LOCKING SYSTEM FOR A WINDOW

FIELD OF THE INVENTION

The invention relates to a locking system for window sashes in a window frame, and more particularly, involves an improved locking system which selectively allows either a vertical sliding movement of the window sash within the window frame or a tilting of the window sash relative to the window frame.

BACKGROUND OF THE INVENTION

Locking devices for window sashes in a window frame are well-known in the art. One such locking device comprises a cam assembly having a rotatable cam element and which is securely fastened to the top of the bottom window sash, and a cam keeper element fastened to the bottom of the top window sash so that when both windows are closed, the rotatable cam element can be operated to move into the cam keeper element for the locking of the window sashes. This locking device is of a simple construction and its operation either locks or unlocks the windows.

Further examples of a locking device for a window sash and/or a door are disclosed in Canadian Patent No. 621,503; British Patent Nos. 1,364,444, and 10,118; and U.S. Pat. Nos. 1,869,274; 4,470,277; and 5,341,752.

Canadian Patent No. 621,503 discloses a locking device for a tiltable window sash comprising two rod elements and an operating handle which positions the locking device into a lock position, or into a first tiltable, opening position for the window sash, or into a further tiltable opening position for the window sash. British Patent No. 1,364,444 discloses an operating mechanism for the operation of a pair of locking bolts for a window or door whereby the bolts are moved into and out of a locking position through a handle-actuator-link mechanism which causes reciprocating movement of the links in an inward direction for releasing of the locking bolts. Canadian Patent No. 10,118 and U.S. Pat. Nos. 1,869,274, 4,470,277, and 5,341,752 show further examples of a handle-actuator-link arrangement for operating a locking device which is used either in a door for a safe or for an automobile.

While some of these prior art locking devices may be adequate for their particular design and/or operation of the window sash or the door, there is still a need in the art to provide an improved locking system which provides an optimum degree of security and safety while still allowing the window sashes to be opened and/or tilted for cleaning purposes.

SUMMARY OF THE INVENTION

The present invention has met the above-described needs. It employs an improved locking system comprising a lock handle assembly which is mounted on a window sash and which operates a lever-link mechanism, which in turn reciprocates two rod elements which extend outwardly from the handle assembly and parallel to the window sash. Each rod element has a tip which extends into a jamb channel in the window frame. A fixed end cap guide is mounted to the window sash to guide the movement of the rod tip into and out of the channel in the frame. Each rod element also has a rotatable cam means with a latch which moves into and out of a cam keeper element which in turn is mounted on a cooperating window sash. For a locking mode, the lock handle assembly may be adjacent to the window sash, the rod elements are in their fully extended position with each tip engaged in the frame, and the latch of each cam means is located within its respective cam keeper element. Rotation of the lock handle assembly to a first position away from the window sash, causes each rod element to be pulled toward the lock handle assembly with its respective rod tip being partially extracted out of the jamb channel in the window frame, and the cam means to be fully rotated to remove its respective latch out of the cam keeper element. This allows vertical movement of the window sash within the window frame and still provides a tracking guide for the window sash in the window since the rod tips are still in the jamb channels of the frame.

Further rotation of the lock handle assembly to a second position relative to the window sash causes each rod element to be further pulled toward the lock handle assembly with its respective rod tip fully retracted out of the jamb channel, and the cam means to be further rotated while remaining in an unlocked position. This allows the window sash to be tilted or rotated outwardly for cleaning of the window sash.

It is therefore, an object of the present invention to provide an improved locking system for window sashes which performs a two-stage operation which upon a first operation of a lock handle assembly permits only vertical movement of at least one window sash within a window frame and which upon a second operation permits tilting of the window sash.

It is a further object of the present invention to provide a locking system for a window sash which involves a lock handle-linkage assembly which upon operation activates cam means for a locking and an unlocking of the system.

It is a further object of the present invention to provide a locking system comprising at least two locking devices which are operated simultaneously through operation of a lock handle assembly for a locking and an unlocking position of two members, which can be moved relative to each other.

It is a further object of the present invention to provide a window locking system which includes a four-point lock arrangement for securing double hung windows in a closed position.

These and other objects of the present invention will be more fully understood from the following description of the invention on reference to the illustrations appended hereto.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims.

FIG. 1 is a front elevational view of a double hung window and sash including a locking system in accordance with an embodiment of the present invention.

FIG. 5 is a side sectional view taken through section 5—5 of FIG. 2 of the locking system in accordance with an embodiment of the invention.

DETAILED DESCRIPTION OF THE PREFERRED EMBODIMENTS

Figure 2:
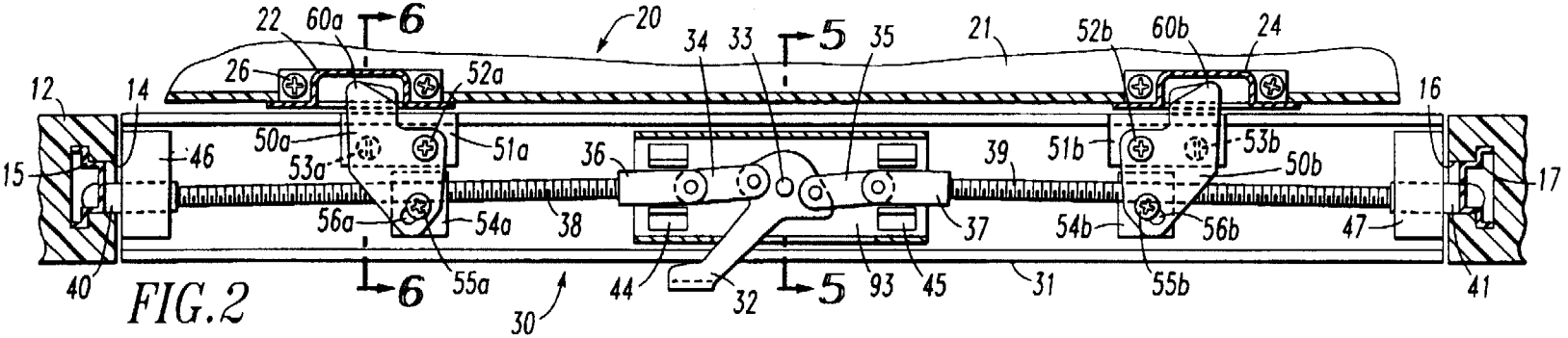
FIG. 2 is top sectional view showing a locking system of the present invention mounted on a window frame in a fully locked position.

Referring to the drawings, wherein like reference numbers represent like elements throughout the several drawings, FIG. 1 shows a locking window assembly 10 including a window frame 12, an upper window sash 20 and a lower window sash 30. The frame 12 and window sashes 20 and 30 may be made from any suitable material such as extruded aluminum, extruded vinyl, fiberglass, wood, composite materials and the like. The window sashes 20 and 30 may include transparent panes made from glass, plastic and the like. The window frame 12 includes jamb channels 14 and 16 which retain the lower window sash 30. The upper window sash 20 is retained in a separate set of jamb channels (not shown). Jamb channel inserts 15 and 17 are secured in the upper portions of the jamb channels 14 and 16. Each insert 15 and 17 provides a retaining ledge under which reciprocating rod tips 40 and 41 are locked when the lower window sash 30 is fully lowered. The inserts 15 and 17 preferably provide elevated surfaces in the upper portions of the jamb channels 14 and 16 which prevent the rod tips 40 and 41 from fully extending into the jamb channels 14 and 16 when the lower sash 30 is raised. A lock handle 32 is mounted on the lower window sash 30 for locking and unlocking the window assembly 10, as more fully described below. While the lock handle 32 shown in the figures is in the form of a lever, other handle configurations such as rotating knobs or sliding bars may be used in accordance with the present invention. The lock handle 32 may optionally be provided with a locking mechanism, such as a key lock (not shown).

The lower window sash 30 has pivot pins 18, 19 which are mounted in conventional balance shoes (not shown) which slide in the jamb channels 14, 16 when the lower sash 30 is raised and lowered. The pivot pins 18 and 19 also retain the lower sash 30 in the window frame 12 when the locking assembly is fully unlocked and the lower window sash is tilted inward for cleaning or the like.

Figure 3:
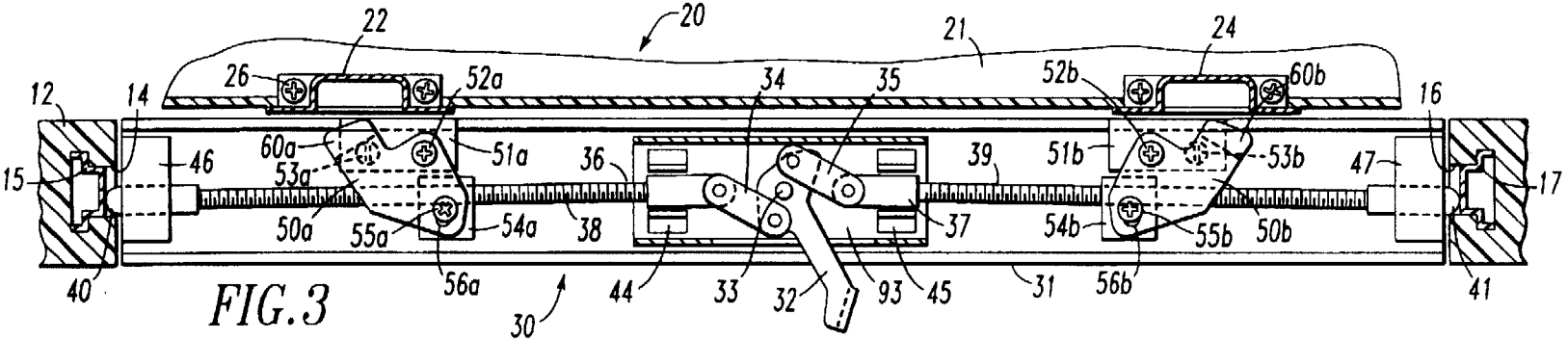
FIG. 3 is a top sectional view of the system shown in FIG. 2 in an unlocked, sliding position.
Figure 4:
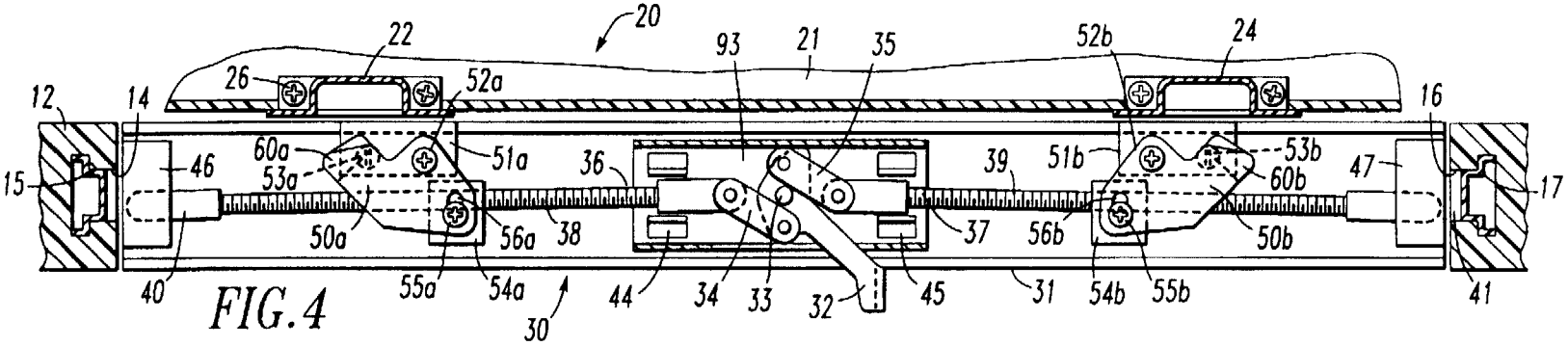
FIG. 4 is a top sectional view of the system shown in FIG. 2 in a fully unlocked, tilt position.

FIGS. 2–4 are top sectional views of the window locking assembly of the present invention in various locking positions. In FIG. 2, the locking assembly is in the fully locked position which secures the upper sash 20 to the lower sash 30. In this fully locked position, the lower sash 30 is also prevented from sliding within the channels 14 and 16. In FIG. 3, the locking assembly is in the unlocked, sliding position which allows the upper and lower window sashes 20 and 30 to slide with respect to each other, and which permits the lower window sash 30 to slide within the channels 14 and 16. In FIG. 4, the locking assembly is in the fully unlocked, tilt position, which allows the lower window sash 30 to be tilted away from the window frame 12 for purposes of cleaning or the like. In addition, the upper sash 20 may be provided with a conventional tilting mechanism including pivot pins at the lower portion of the sash which pivotally retain the upper sash in the window frame.

As shown in each of FIGS. 2–4, the locking assembly in accordance with a preferred embodiment of the present invention includes a lock handle 32 rotatably mounted on the lower window sash frame 31 by means of a pivot member 33 such as a shaft, pin or bolt which is secured to a housing 93. Links 34 and 35 connect the lock handle 32 to reciprocating couplings 36 and 37. Each coupling 36, 37 is connected to a reciprocating rod 38, 39 which extends toward the window frame 12. Each reciprocating rod 38, 39 has a rod tip 40, 41 which may be extended outwardly from the lower window sash frame 31 for engagement with the jamb channel 14, 16. When the lock handle 32 is rotated clockwise into the fully locked position shown in FIG. 2, the links 34 and 35 preferably are offset at a slight angle of about 5 degrees with respect to the reciprocating rods 38 and 39. This provides an over the center locking action which prevents retraction of the rods 38 and 39 if axial pressure is applied to the rod tips 40 and 41. Movement of the reciprocating rods 38 and 39 is guided by bushings 46 and 47, and bent tabs 44 and 45. In the preferred embodiment shown in FIGS. 2–4, the reciprocating rods 38 and 39 are threaded along their lengths, which allows the rod tips 40 and 41 to be adjusted into the appropriate position with respect to the channels 14 and 16.

The locking assembly shown in FIGS. 2–4 also includes cam assemblies **50*a* and 50*b* which act to secure the upper window sash 20 to the lower window sash 30. Each cam 50*a*, 50*b* is rotatably mounted on the lower window sash frame 31 by means of a pivot member 52*a*, 52*b* such as a shaft, pin, or bolt which is fastened to a bracket 51*a*, 51*b*. Each bracket 51*a*, 51*b* is secured to the lower sash frame 31 by fasteners such as screws 53*a*, 53*b*. The cams 50*a* and 50*b* are received within keeper slots 22 and 24 which are secured to the upper sash frame 21 by fasteners such as screws 26. The cam 50*a* is rotated about the pivot member 52*a* by the reciprocating movement of the rod 38. A threaded carrier 54*a* connected to the threaded reciprocating rod 38 has a screw pin 55*a* that engages in a slot 56*a* which extends through the cam 50*a*. Reciprocating movement of the rod 38 and carrier 54*a* thus actuates the cam 50*a* to thereby rotate into a locked or unlocked position. The threaded carrier 54*a* may be adjusted to the desired axial position on the threaded rod 38 in order to provide optimum engagement between the cam 50*a* and the keeper 22. The cam 50*a* includes a latch portion 60*a* that is receivable within a keeper slot 22 in the upper window sash frame 21. In a similar manner, the cam assembly 50*b* is actuated by a threaded carrier 54*b* and screw pin 55*b* mounted on the threaded reciprocating rod 39. The pin 55*b* extends through a slot 56*b* in the cam 50*b*. Reciprocating movement of the rod 39 causes the cam 50*b* to rotate about the pivot member 52*b* to thereby engage or disengage the cam latch 60*b* within the keeper slot 24 of the upper window sash frame 21**.

In the fully locked position shown in FIG. 2, the lock handle 32 is rotated about the pivot member 33 to a position almost flush against the lower window sash frame 31. In this position, the reciprocating rods 38 and 39 are fully extended such that the rod tips 40 and 41 extend into the jamb channels 14 and 16 underneath the retainer inserts 15 and 17. The lower window sash 30 is thus locked against relative movement within the window frame 12 through the contact of the end tips 40 and 41 and the undersides of the retainer inserts 15 and 17. When the rod tips 40 and 41 are fully inserted into the jamb channels 14 and 16, each tip contacts the side of its respective jamb channel to produce a camming action between the rod tips and the sides of the jamb channels which draws the upper and lower window sashes 20 and 30 together.

In the fully locked position shown in FIG. 2, the upper window sash 20 and lower window sash 30 are also secured against relative movement. This is accomplished by positioning the lock handle 32 against the lower window sash frame 31 as shown to thereby fully extend the reciprocating rods 38 and 39. In the fully extended position, the reciprocating rods 38 and 39 force the cams 50*a* and 50*b* to rotate into the positions shown in FIG. 2 in which the cam latches 60*a* and 60*b* are inserted into the keeper slots 22 and 24 in the upper window sash frame 21.

The fully locked position of the locking assembly shown in FIG. 2 provides improved securement due to the use of multiple locking points. Contrary to conventional lock arrangements, the locking assembly shown in FIG. 2 provides four contact points for securing the window in the locked position. Relative movement between the upper and lower window sashes is prevented by insertion of the two cam latches 60*a* and 60*b* into the keeper slots 22 and 24 of the upper window sash frame 21. In addition, sliding movement of the lower window sash 30 relative to the window frame 12 is prevented through the use of two contact points. Reciprocating rod tips 40 and 41 extend from the ends of the lower window sash frame 31 to engage underneath retainer inserts 15 and 17 in the window frame 12. Thus, the four-point locking assembly shown in FIG. 2 provides improved securement in comparison with conventional locking assemblies.

FIG. 3 illustrates the locking assembly in the unlocked, sliding position. The lock handle 32 is rotated counterclockwise from the position shown in FIG. 2 to thereby retract the reciprocating rods 38 and 39 a sufficient distance such that the rod tips 40 and 41 are no longer underneath the retainer inserts 15 and 17. In this position, each rod tip 40, 41 is free to slide within its respective channel 14, 16 against the surface of its respective retainer insert 15, 17. However, the rod tips 40 and 41 are still extended a sufficient distance from the lower window sash frame 31 such that they are guided within the jamb channels 14 and 16 as the lower window sash 30 is raised and lowered.

In the unlocked, sliding position shown in FIG. 3, the cams 50*a* and 50*b* are rotated out of engagement with the keeper slots 22 and 24 by the reciprocating movement of the rods 38 and 39. Thus, in the position shown in FIG. 3, the upper and lower window sashes 20 and 30 are free to slide in relation to each other.

FIG. 4 illustrates the locking assembly of the present invention in the fully unlocked, tilt position. The lock handle 32 is raised and rotated counterclockwise from the position shown in FIG. 3 to a position which causes the reciprocating rods 38 and 39 to be fully retracted into the lower window sash frame 31. In this position, the reciprocating rod tips 40 and 41 no longer ride within the jamb channels 14 and 16, thereby allowing the lower window sash 30 to be tilted by rotation about the pivot pins 18 and 19. In the fully unlocked position shown in FIG. 4, the cam latches 60*a* and 60*b* remain disengaged from the keeper slots 22 and 24 of the upper window sash frame 21.

Figure 6:
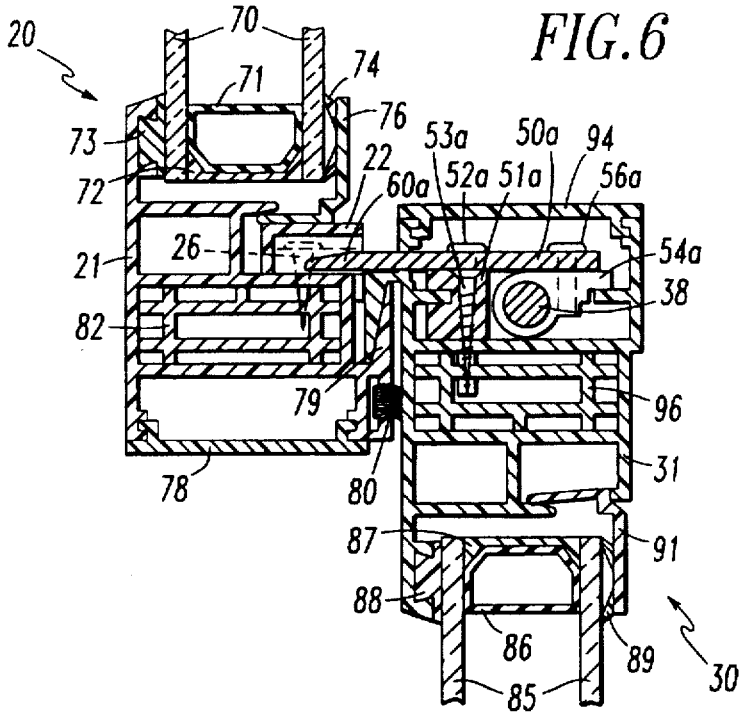
FIG. 6 is another side sectional view taken through section 6—6 of FIG. 2 of the locking system in accordance with an embodiment of the invention.

FIGS. 5 and 6 are side sectional views taken through FIG. 2 showing a window locking assembly in accordance with a preferred embodiment of the present invention. Upper window panes 70 are mounted in the upper window sash frame 21 by means of a spacer 71 made of steel, aluminum or the like, and seals 72, 73 and 74. Alternatively, the spacer 71 and seal 72 can be provided as a single component such as aluminum reinforced butyl rubber. While double-pane windows are shown in FIGS. 5 and 6, it is to be understood that single-pane windows as well as multiple-pane windows are embodied by the present invention. A glazing lock strip 76 secures the upper window panes 70 to the upper window sash frame 21. As shown in FIG. 6, the keeper 22 is fastened to an aluminum reinforcing member 82 inside the frame 21 by fasteners such as screws 26. A bottom cover 78 is secured to the upper window sash frame 21. The frame 21 includes an upwardly extending lip 79. Weather stripping 80 is mounted in a groove in the upper window sash frame 21.

As shown in FIGS. 5 and 6, the lower window sash 30 includes window panes 85 which are separated by a spacer 86, and which are sealed to the lower window sash frame 31 by a series of seals 87, 88 and 89. The spacer 86 and seal 87 can alternatively be provided as a single component such as aluminum reinforced butyl rubber. A retainer strip 91 secures the lower window panes 85 within the lower window sash frame 31. In FIG. 5, a housing 93 made of metal or the like is fastened to the lower window sash frame 31 by any suitable means such as screws, rivets, welding or the like (not shown) which are preferably anchored in an aluminum reinforcing member 96. The housing 93 contains the pivot member 33, links 34 and 35, and reciprocating couplings 36 and 37 of the window locking assembly of the present invention. A spring 97 surrounds the pivot member 33 and bears against the housing 93 and lock handle 32 in order to force the lock handle 32 downward while permitting limited vertical movement of the lock handle. A cover plate 94 is secured to the frame 31 to thereby conceal the handle and other components of the locking assembly, and to permit access thereto for repair or replacement. The aluminum reinforcing member 96 provides structural support for the lower sash frame 31. As shown in FIG. 6, the cam 50*a* is pivotally mounted on the bracket 51*a* which in turn is secured to the lower frame 31 by a screw which is anchored to the aluminum reinforcing member 96. Likewise, the keeper 22 is secured to the aluminum reinforcing member 82 in the upper frame 21 by means of the screws 26. This anchoring of the cam and keeper assemblies to the aluminum reinforcing members provides additional security against forced entry. The lower window sash frame 31 includes a downwardly extending lip 95 which engages the upwardly extending lip 79 of the upper window sash frame 21 in order to guide the upper and lower sashes 20 and 30 into proper alignment when the sashes are closed, as shown in FIGS. 5 and 6. In addition to providing a weather-tight seal, the extending lips 79 and 95 provide additional securement against unwanted entry by preventing the upper and lower window sashes 20 and 30 from being pulled apart from each other in a horizontal direction as shown in FIGS. 5 and 6.

Figure 7:
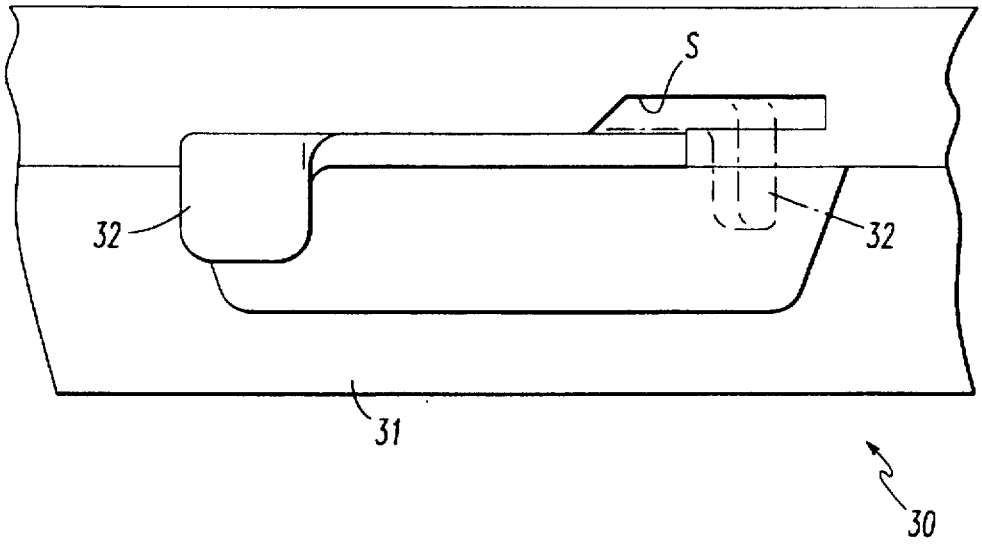
FIG. 7 is a front elevational view of a portion of a lower window sash frame including a lock handle in accordance with an embodiment of the present invention.

FIG. 7 shows a portion of the lower window sash frame 31 with the lock handle 32 in the fully locked position, and with the lock handle 32 in the fully unlocked, tilt position (in phantom). The lock handle 32 rides in a slot S which has a stepped portion toward its right side. This stepped portion permits the lock handle 32 to be moved horizontally from the left, fully locked position (as shown in FIG. 2) to the middle, unlocked sliding position (as shown in FIG. 3), but requires the lock handle 32 to be moved vertically before it can be positioned in the fully unlocked, tilt position (as shown in FIG. 4). As shown in FIG. 5, the spring 97 forces the lock handle 32 downward, while permitting limited vertical movement of the lock handle. In this manner, the lock handle 32 simply moves horizontally from the fully locked position to the unlocked sliding position, but requires additional manipulation in the vertical direction against the force of the spring 97 before the assembly can be set in the tilt position.

The locking assembly of the present invention provides several advantages over conventional window locking arrangements. In accordance with the present invention, a single operating handle may be used to achieve multiple locked and unlocked positions. Depending on the position of the handle, the assembly may be placed in a fully locked position, placed in an unlocked, sliding position, or placed in a fully unlocked, tilting position. Furthermore, the locking assembly of the present invention provides a highly secure, multiple-point locking system which greatly reduces the risk of unwanted entry. In the preferred embodiment, the upper and lower window sashes are locked to each other at two separate points, and the sashes are locked within the window frame at two additional points of contact. A highly secure locking mechanism is therefore provided which can be actuated using a single handle. The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A window assembly comprising:

a frame including at least one retaining member;

a first window sash slidably mounted in the frame;

a second window sash slidably mounted in the frame;

at least one rotatable locking member mounted on the first window sash and moveable to: (1) a locked position in engagement with the second window sash; and (2) an unlocked position disengaged from the second window sash;

at least one reciprocating locking member mounted on the first window sash and moveable to: (1) an extended position in locking engagement with the at least one retaining member of the frame resisting the first window sash from sliding in the frame; (2) a partially retracted position allowing the first window sash to slide in the frame; and (3) a fully retracted position allowing the first window sash to tilt out of the frame; and a lock handle assembly mounted on the first window sash, connected to the at least one rotatable locking member and the at least one reciprocating locking member, and moveable to: (1) a fully locked position wherein the at least one rotatable locking member is in the locked position and the at least one reciprocating locking member is in the extended position; (2) a sliding position wherein the at least one rotatable locking member is in the unlocked position and the at least one reciprocating locking member is in the partially retracted position; and (3) a tilt position wherein the at least one rotatable locking member is in the unlocked position and the at least one reciprocating locking member is in the fully retracted position.

2. The window assembly of claim 1, wherein the at least one reciprocating locking member comprises a rod.

3. The window assembly of claim 2, wherein the rod is threaded.

4. The window assembly of claim 3, wherein the at least one rotatable locking member is mounted on a bracket that is adjustably positioned along a length of the threaded rod.

5. The window assembly of claim 3, further comprising an axially adjustable tip attached to the threaded rod.

6. The window assembly of claim 5, further comprising:

at least one guide mounted on the first window sash in contact with the axially adjustable tip.

7. The window assembly of claim 1, wherein the at least one rotatable locking member comprises a cam adjustably mounted on the rod.

8. The window assembly of claim 1, wherein the assembly includes two of the reciprocating locking members which extend in substantially opposite directions from the first window sash.

9. The window assembly of claim 8, wherein the assembly includes two of the rotatable locking members which extend from the first window sash in a direction substantially perpendicular to a direction of extension of the reciprocating locking members when the lock handle assembly is in the fully locked position.

10. The window assembly of claim 1 further comprising:

an engageable lip connected to each of the first and second window sashes.

11. The window assembly of claim 10, wherein the engageable lips contact each other when the first and second window sashes are in a closed position to resist lateral displacement of the first and second window sashes away from each other in a direction substantially perpendicular to the sliding direction of the first window sash.

12. The window assembly of claim 1, wherein the lock handle assembly comprises a handle element pivotally mounted on the first window sash and connected to the at least one reciprocating locking member by a linkage.

13. The window assembly of claim 1, wherein the lock handle assembly comprises:

a housing, an actuator including a linkage connected to the at least one reciprocating locking member, and a handle element connected to the linkage.

14. The window assembly of claim 1, wherein the at least one reciprocating locking member comprises means for resisting retraction of the at least one reciprocating locking member when the member is in the extended position and axial pressure is applied to an end of the at least one reciprocating member.

15. The window assembly of claim 14, wherein the means for resisting retraction comprises an over the center linkage connected to the at least one reciprocating locking member.

16. The window assembly of claim 1, wherein the at least one reciprocating locking member contacts a side of a channel of the frame when the reciprocating locking member is in the fully extended position to thereby draw the first window sash toward the second window sash.

17. A window assembly comprising:

a first window sash;

a second window sash;

at least one rotatable locking member mounted on the first window sash moveable to: (1) a locked position in engagement with the second window sash; and (2) an unlocked position disengaged from the second window sash;

at least one reciprocating locking member mounted on the first window sash moveable to: (1) an extended position; (2) a partially retracted position; and (3) a fully retracted position; and a lock handle assembly mounted on the first window sash, connected to the at least one rotatable locking member and the at least one reciprocating locking member, and moveable to: (1) a first position wherein the at least one rotatable locking member is in the locked position and the at least one reciprocating locking member is in the extended position; (2) a second position wherein the at least one rotatable locking member is in the unlocked position and the at least one reciprocating locking member is in the partially retracted position; and (3) a third position wherein the at least one rotatable locking member is in the unlocked position and the at least one reciprocating locking member is in the fully retracted position.

18. The window assembly of claim 17, wherein the at least one reciprocating locking member comprises a rod.

19. The window assembly of claim 18, wherein the at least one rotatable locking member comprises a cam adjustably mounted on the rod.

20. The window assembly of claim 19, further comprising:

a cam keeper mounted on the second window sash engageable with the cam.

21. The window assembly of claim 18, wherein the rod is threaded.

22. The window assembly of claim 21, wherein the at least one rotatable member is mounted on a bracket that is adjustably positioned along a length of the threaded rod.

23. The window assembly of claim 21, further comprising an axially adjustable tip attached to the threaded rod.

24. The window assembly of claim 17, wherein the assembly includes two of the reciprocating locking members which extend in substantially opposite directions from the first window sash.

25. The window assembly of claim 24, wherein the assembly includes two of the rotatable locking members which extend from the first window sash in a direction substantially perpendicular to a direction of extension of the reciprocating locking members when the reciprocating locking members are fully extended from the first window sash.

26. The window assembly of claim 17, further comprising:

an engageable lip connected to each of the first and second window sashes.

27. The window assembly of claim 17, wherein the lock handle assembly comprises a handle element pivotally mounted on the first window sash and connected to the at least one reciprocating locking member by a linkage.

28. The window assembly of claim 17, wherein the at least one reciprocating locking member comprises means for resisting retraction of the at least one reciprocating locking member when the member is in the extended position and axial pressure is applied to an end of the at least one reciprocating member.

29. The window assembly of claim 28, wherein the means for resisting retraction comprises an over the center linkage connected to the at least one reciprocating locking member.

30. A window sash locking system comprising:

a window sash;

at least one rotatable locking member mounted on the window sash moveable to: (1) an extended position; and (2) a retracted position;

at least one reciprocating locking member mounted on the window sash moveable to: (1) an extended position; (2) a partially retracted position; and (3) a fully retracted position; and a lock handle assembly mounted on the first window sash, connected to the at least one rotatable locking member and the at least one reciprocating locking member, and moveable to: (1) a first position wherein the at least one rotatable locking member is in the extended position and the at least one reciprocating locking member is in the extended position; (2) a second position wherein the at least one rotatable locking member is in the retracted position and the at least one reciprocating locking member is in the partially retracted position; and (3) a third position wherein the at least one rotatable locking member is in the retracted position and the at least one reciprocating locking member is in the fully retracted position.

31. The system of claim 30, wherein the at least one reciprocating locking member comprises a rod.

32. The system of claim 31, wherein the at least one rotatable locking member comprises a cam adjustably mounted on the rod.

33. The system of claim 31, wherein the rod is threaded.

34. The system of claim 30, wherein the lock handle assembly comprises a handle element pivotally mounted on the window sash and connected to the at least one reciprocating locking member by a linkage.

35. The system of claim 30, wherein the at least one rotatable member is mounted on a bracket that is adjustably positioned along a length of threaded rod.

36. The system of claim 30, wherein the system comprises two of the rotatable locking members and two of the reciprocating locking members.

37. The system of claim 30, further comprising an axially adjustable tip attached to the threaded rod.

38. The system of claim 30, wherein the at least one reciprocating locking member comprises means for resisting retraction of the at least one reciprocating locking member when the member is in the extended position and axial pressure is applied to an end of the at least one reciprocating member.

39. The system of claim 38, wherein the means for resisting retraction comprises an over the center linkage connected to the at least one reciprocating locking member.

40. A window assembly comprising:

a frame including at least one retaining member;

a first window sash slidably mounted in the frame;

a second window sash slidably mounted in the frame;

at least one rotatable locking member mounted on the first window sash and engaged with the second window sash to resist relative movement of the first and second window sashes; and at least one reciprocating locking member extending from the first sash and engaged with the at least one retaining member of the frame to lock the first sash in a closed position in the frame, wherein the reciprocating locking member comprises a threaded rod and the at least one rotatable member is mounted on a bracket that is adjustably positioned along a length of the threaded rod.

41. The window assembly of claim 40, wherein the at least one reciprocating locking member comprises means for resisting retraction of the at least one reciprocating locking member when the member is in the extended position and axial pressure is applied to an end of the at least one reciprocating member.

42. A window assembly comprising:

a frame including at least one retaining member;

a first window sash slidably mounted in the frame;

a second window sash slidably mounted in the frame;

at least one reciprocating locking member mounted on the first window sash; and at least one rotatable locking member rotatably mounted on the first window sash and engaging the at least one reciprocating locking member such that axial movement of the at least one reciprocating locking member rotates the at least one rotatable locking member, wherein the at least one rotatable locking member is adjustably positioned along a length of the at least one reciprocating locking member.

43. The window assembly of claim 42, wherein the at least one reciprocating locking member is moveable to: (1) an extended position in locking engagement with the at least one retaining member of the frame resisting the first window sash from sliding in the frame; (2) a partially retracted position allowing the first window sash to slide in the frame; and (3) a fully retracted position allowing the first window sash to tilt out of the frame.

44. The window assembly of claim 42, wherein the at least one reciprocating locking member comprises a threaded rod.

45. The window assembly of claim 44, wherein the at least one rotatable member is mounted on a bracket that is adjustably positioned along a length of the threaded rod.

46. The window assembly of claim 42, wherein the assembly comprises two of the rotatable locking members and two of the reciprocating locking members.

47. A window assembly comprising:

a frame including at least one retaining member;

a first window sash slidably mounted in the frame;

a second window sash slidably mounted in the frame;

at least one rotatable locking member mounted on the first window sash moveable to: (1) a locked position in engagement with the second window sash; and (2) an unlocked position disengaged from the second window sash; and at least one reciprocating locking member mounted on the first window sash having an axially adjustable tip, the at least one reciprocating locking member being moveable to: (1) an extended position engaged with the at least one retaining member of the frame resisting the first window sash from sliding in the frame; (2) a partially retracted position allowing the first window sash to slide in the frame; and (3) a fully retracted position allowing the first window sash to tilt out of the frame.

48. The window assembly of claim 47, wherein the at least one reciprocating member comprises a threaded rod.

49. The window assembly of claim 48, wherein the at least one rotatable member is mounted on a bracket that is adjustably positioned along a length of the threaded rod.

50. The window assembly of claim 47, wherein the assembly comprises two of the rotatable locking members and two of the reciprocating locking members.

* * * * *